US008422927B2

(12) United States Patent
Kobayashi et al.

(10) Patent No.: US 8,422,927 B2
(45) Date of Patent: Apr. 16, 2013

(54) FIXING DEVICE AND IMAGE FORMING APPARATUS

(75) Inventors: Yasuyuki Kobayashi, Kanagawa (JP); Kenji Kanai, Kanagawa (JP); Masakatsu Eda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 300 days.

(21) Appl. No.: 13/007,149

(22) Filed: Jan. 14, 2011

(65) Prior Publication Data

US 2011/0311285 A1 Dec. 22, 2011

(30) Foreign Application Priority Data

Jun. 21, 2010 (JP) ..... 2010-140683

(51) Int. Cl.
*G03G 15/20* (2006.01)

(52) U.S. Cl.
USPC ..... 399/325

(58) Field of Classification Search ..... 399/325–327, 399/335, 69
See application file for complete search history.

(56) References Cited

U.S. PATENT DOCUMENTS

| | | | | |
|---|---|---|---|---|
| 6,411,785 | B1 | 6/2002 | Ogawahara et al. | |
| 7,107,001 | B2 * | 9/2006 | Kameda | 399/69 |
| 7,706,707 | B2 * | 4/2010 | Minakuchi et al. | 399/69 |
| 8,233,831 | B2 * | 7/2012 | Nakayama et al. | 399/327 |
| 2009/0087202 | A1 * | 4/2009 | Hurst et al. | 399/69 |
| 2010/0183345 | A1 * | 7/2010 | Kagawa et al. | 399/327 |
| 2011/0236082 | A1 * | 9/2011 | Kobayashi et al. | 399/327 |

FOREIGN PATENT DOCUMENTS

| | | |
|---|---|---|
| JP | 3736240 | 1/2006 |

* cited by examiner

*Primary Examiner* — Susan Lee
(74) *Attorney, Agent, or Firm* — Sughrue Mion, PLLC

(57) ABSTRACT

A fixing device includes: a fixing member that fixes a developer image on a recording medium while rotating; an external heating member that heats the fixing member, the external heating member being driven-rotated by rotation of the fixing member while contacting with an outer peripheral face of the fixing member; an oil supply member that supplies oil to a surface of the external heating member; a switching unit that switches between contact and non-contact of the external heating member to the outer peripheral face of the fixing member, the switching unit causing the external heating member to contact with the outer peripheral face of the fixing member after a fixing operation by the fixing member is started; and a rotation mechanism that rotates the fixing member and rotates the external heating member in a state where the external heating member is separated from the fixing member by the switching unit.

12 Claims, 9 Drawing Sheets

COMPARATIVE EXAMPLE

FIXING DEVICE AND IMAGE FORMING APPARATUS

CROSS-REFERENCE TO RELATED APPLICATION

This application is based on and claims priority under 35 USC 119 from Japanese Patent Application No. 2010-140683 filed Jun. 21, 2010.

BACKGROUND

Technical Field

The present invention relates to a fixing device and an image forming apparatus.

SUMMARY

An aspect of the present invention is a fixing device including: a fixing member that fixes a developer image on a recording medium while rotating; an external heating member that heats the fixing member, the external heating member being driven-rotated by rotation of the fixing member while contacting with an outer peripheral face of the fixing member; an oil supply member that supplies oil to a surface of the external heating member; a switching unit that switches between contact and non-contact of the external heating member to the outer peripheral face of the fixing member, the switching unit causing the external heating member to contact with the outer peripheral face of the fixing member after a fixing operation by the fixing member is started; and a rotation mechanism that rotates the fixing member and rotates the external heating member in a state in which the external heating member is separated from the fixing member by the switching unit.

BRIEF DESCRIPTION OF THE DRAWINGS

An exemplary embodiment of the present invention will be described in detail based on the following figures, wherein.

DETAILED DESCRIPTION

Explanation follows regarding an example of a fixing device and an image forming apparatus according to an exemplary embodiment of the present invention.

Figure 1:
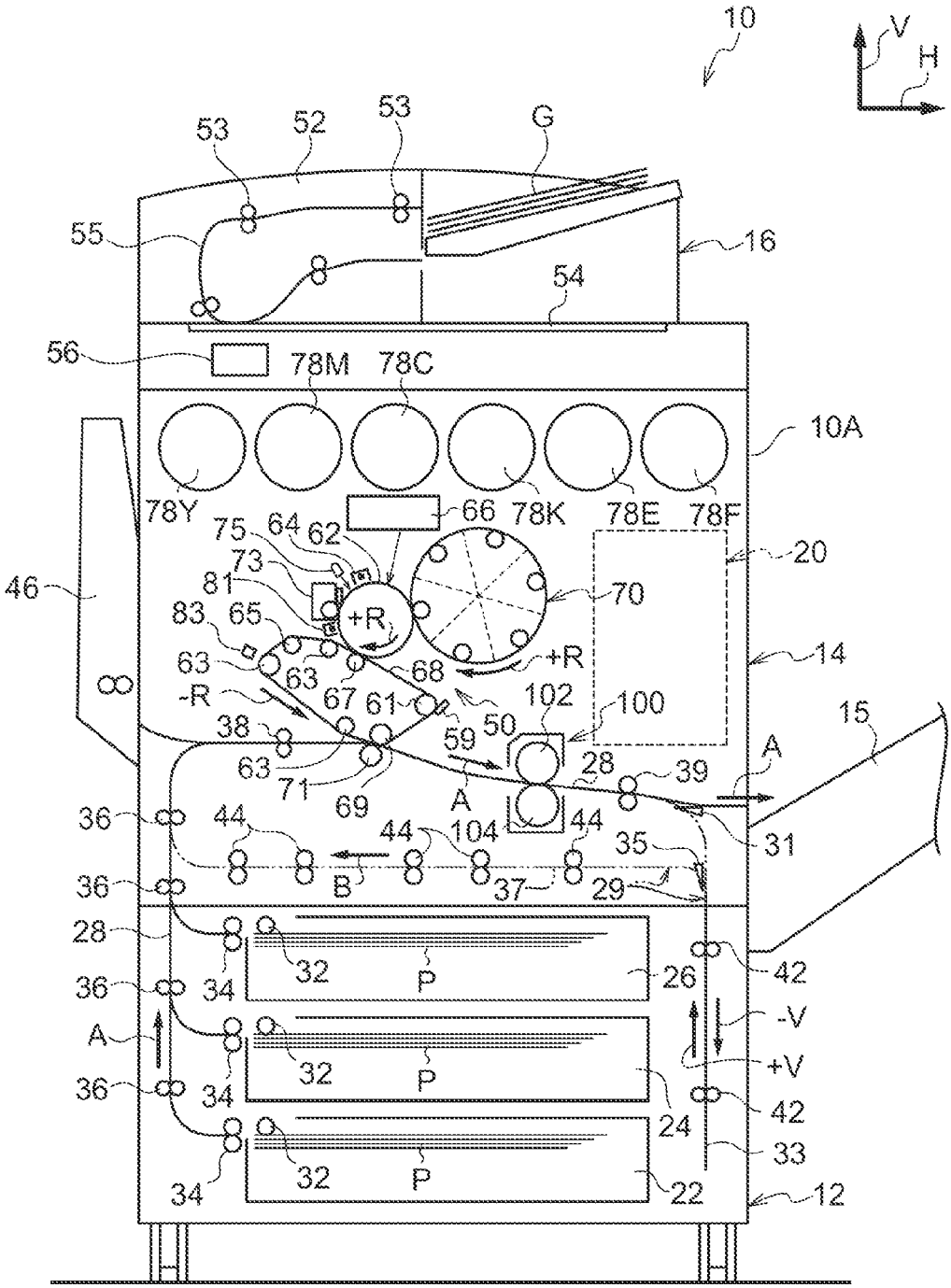
FIG. 1 is an overall configuration diagram of an image forming apparatus according to an exemplary embodiment of the present invention.

FIG. 1 shows an image forming apparatus 10 as an exemplary embodiment. The image forming apparatus 10 is configured including, from the bottom towards the top in the vertical direction (direction of arrow V): a paper housing unit 12 that houses recording paper P; an image forming section 14 provided above the paper housing unit 12 and performing image forming on the recording paper P, serving as an example of a recording medium and supplied from the paper housing unit 12; an original reading unit 16 provided above the image forming section 14, reading an original to be read G; and a control unit 20 provided inside the image forming section 14 and controlling operation of each section of the image forming apparatus 10. In the following explanation, the vertical direction of an apparatus main body 10A of the image forming apparatus 10 is referred to as the arrow V direction, and the horizontal direction is referred to as the arrow H direction.

The paper housing unit 12 is provided with a first housing unit 22, a second housing unit 24, and a third housing unit 26 housing different sizes of the recording paper P. Feed rolls 32 are provided in the first housing unit 22, the second housing unit 24, and the third housing unit 26, respectively, feeding out the housed recording paper P to a transporting path 28 provided within the image forming apparatus 10. Pairs of transporting rolls 34 and transporting rolls 36 are provided at the downstream side of the feed rolls 32 on the transporting path 28, that transports the recording paper P one sheet at a time. Positioning rolls 38 are provided on the transporting path 28 downstream side of the transporting rolls 36 in the recording paper P transporting direction, that temporarily stops the recording paper P and feeds the recording paper P out to a second transfer position QB (see FIG. 2), described below, at a particular timing.

The upstream side portion of the transporting path 28, as viewed from the front face of the image forming apparatus 10, is provided, in a straight line manner, along the arrow V direction from the left hand side of the paper housing unit 12 to a left hand side lower portion of the image forming section 14. The downstream side portion of the transporting path 28 is provided from the left hand side lower portion of the image forming section 14 up to a paper discharge unit 15 provided at the right hand face of the image forming section 14. A double-side transporting path 29 is connected to the transporting path 28, that transports and reverses the recording paper P in order to perform image forming on both sides of the recording paper P.

The double-side transporting path 29 includes, when viewed from the front face of the image forming apparatus 10: a first switching member 31 that switches between the transporting path 28 and the double-side transporting path 29; a reversing section 33 provided in a straight line manner along the arrow V direction (−V denotes downwards and +V denotes upwards in the drawing) from a right hand side lower portion of the image forming section 14 to the right hand side of the paper housing unit 12; a transporting section 37 that transports the recording paper P in the arrow H direction towards the left hand side in the drawing, the trailing end of the recording paper P which is transported to the reversing section 33 being entered into the transporting section 37; and a second switching member 35 that switches between the reversing section 33 and the transporting section 37. Pairs of transporting rolls 42 are provided at plural locations at intervals in the reversing section 33 and pairs of transporting rolls 44 are provided at plural locations at intervals in the transporting section 37.

The first switching member 31 is a triangular pillar shaped member configured so as to switch the transporting direction of the recording paper P by the leading end portion of the first switching member 31 being moved by a drive unit (not shown in the drawings) to the transporting path 28 or the double-side transporting path 29. Similarly, the second switching member 35 is a triangular pillar shaped member as viewed from the front face, configured so as to switch the transporting direction of the recording paper P by the leading end portion of the second switching member 35 being moved by a drive unit, not shown in the drawings, to the reversing section 33 or the transporting section 37. The downstream end portion of the transporting section 37 is connected by a guide member (not shown in the drawings) to a position at near side of transporting rolls 36 located on the upstream portion of the transporting path 28. A foldable manual paper feed unit 46 is also provided to the left hand face of the image forming section 14, and transporting path of recording paper P fed in from the manual paper feed section 46 is connected to the transporting path 28 at near side of the positioning rolls 38.

The original reading unit 16 is provided with: an original transporting device 52 that automatically transports an original to be read G one sheet at a time; a platen glass 54, disposed at the lower side of the original transporting device 52 and on which a single sheet of original to be read G is placed; and an original reading device 56 that reads the original to be read G transported by the original transporting device 52 or the original to be read G placed on the platen glass 54.

The original transporting device 52 includes an automatic transporting path 55 on which plural pairs of transporting rolls 53 are disposed, and a portion of the automatic transporting path 55 is disposed such that the original to be read G passes across the platen glass 54. The original reading device 56 reads in a stationary state at the left hand end portion of the platen glass 54 the original to be read G that has been transported by the original transporting device 52, or reads in the original to be read G that has been placed on the platen glass 54 while it moving in the arrow H direction.

The image forming section 14 includes an image forming unit 50, serving as an example of a developer image forming section, that forms a toner image (developer image) on the recording paper P. The image forming unit 50 is configured including a photoreceptor 62, a charging member 64, an exposing device 66, a developing device 70, an intermediate transfer belt 68, and a cleaning device 73, as described below.

The image forming section 14 is provided with the circular cylinder shaped photoreceptor 62, serving as an example of a latent image carrier, at a central portion of the apparatus main body 10A. The photoreceptor 62 is configured so as to be rotated in the arrow+R direction (the clockwise direction in the drawing) by a drive section (not shown in the drawings) and to hold an electrostatic latent image formed by irradiation of light thereon. The corotron type charging member 64 is provided at a position above the photoreceptor 62 and facing the outer peripheral face of the photoreceptor 62, that charges the surface of the photoreceptor 62.

The exposing device 66 is provided at a position downstream of the charging member 64 in the photoreceptor 62 rotation direction and facing the outer peripheral face of the photoreceptor 62. The light-exposing device 66 includes a semiconductor laser, an f-O lens, a polygon mirror, an imaging lens, and plural mirrors, not shown in the drawings. The exposing device 66 is configured to form an electrostatic latent image by deflection-scanning with the polygon mirror a laser beam emitted from the semiconductor laser based on an image signal, and illuminating (exposing) the outer peripheral face of the photoreceptor 62 that has been charged by the charging member 64. Note that the exposing device 66 is not limited to the method of deflection-scanning a laser beam using a polygon mirror, and a Light Emitting Diodes (LED) method may be used.

A developing device 70 is provided at further downstream side in the photoreceptor 62 rotation direction than the illuminated portion of exposure light from the exposing device 66. The developing device 70 is a rotation-switch-over device that develops an electrostatic latent image formed on the outer peripheral face of the photoreceptor 62 with given colors of toners and makes the electrostatic latent image visible.

Figure 2:
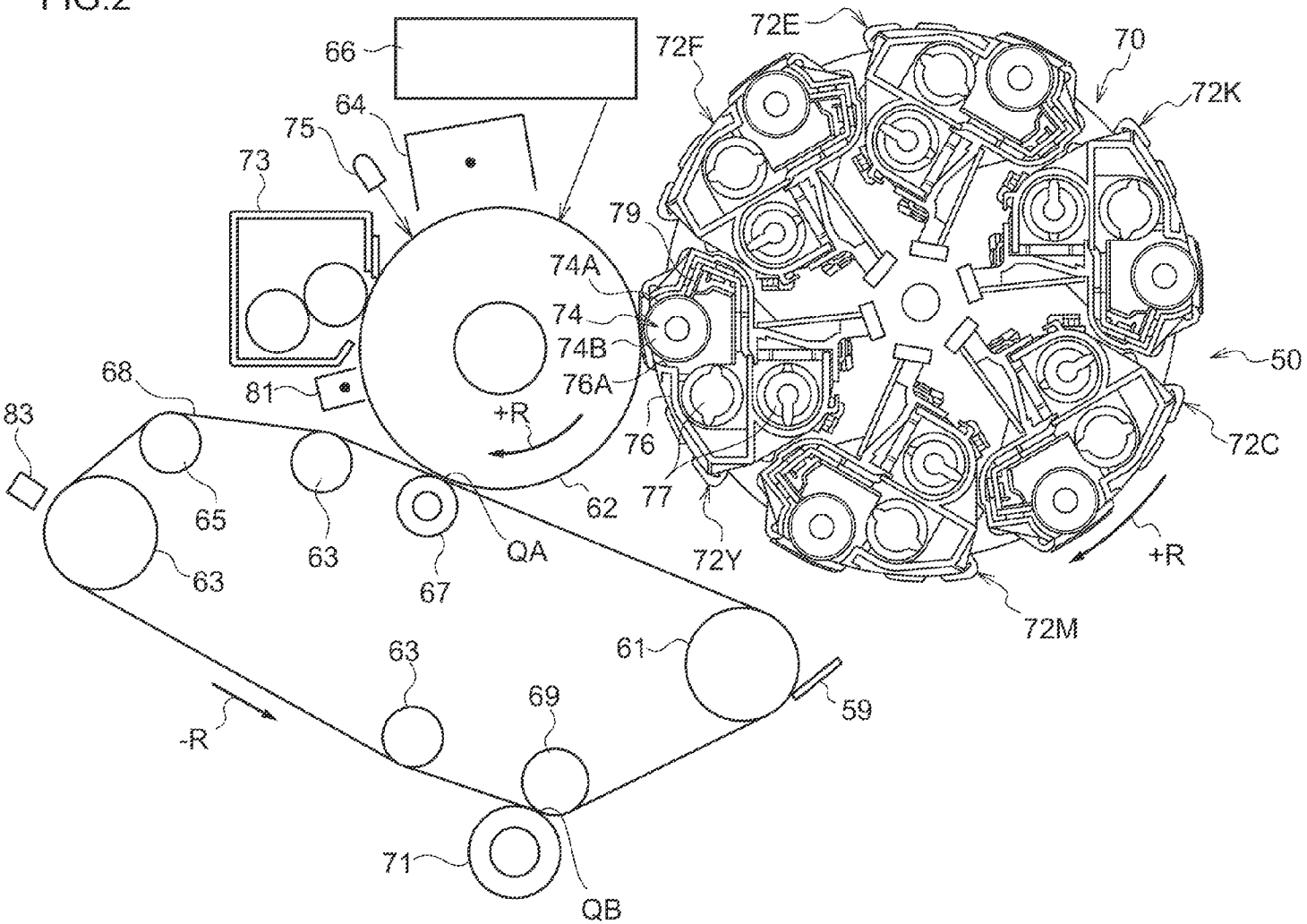
FIG. 2 is a configuration diagram of an image forming unit according to an exemplary embodiment of the present invention.

As shown in FIG. 2, the developing device 70 includes developer units 72Y, 72M, 72C, 72K, 72E, 72F disposed and arranged thereat side by side (in this order in the anticlockwise direction) along the peripheral direction of the developing device 70, corresponding to each of the toner colors yellow (Y), magenta (M), cyan (C), black (K), first special color (E), and second special color (F), respectively. The developer units 72Y, 72M, 72C, 72K, 72E, 72F are provided such that the developer unit 72Y, 72M, 72C, 72K, 72E or 72F which is to be used for performing development processing is switched over to face the outer peripheral face of the photoreceptor 62 by rotating the developing device 70 through a central angle of 60° at a time with using a motor (not shown in the drawings).

Note that, since the developer units 72Y, 72M, 72C, 72K, 72E, 72F are each of a similar configuration, explanation will be given here of developer unit 72Y, and further explanation of the other developer units 72M, 72C, 72K, 72E, 72F omitted. Furthermore, when performing image forming with 4-colors Y, M, C, K, since the developer units 72E and 72F are not used, the rotation angle from the developer unit 72K to the developer unit 72Y becomes 180°.

The developer unit 72Y includes a case member 76 as the main body thereof, and the case member 76 is filled with a developer (not shown in the drawings), formed from a carrier and a toner supplied through a toner supply path (not shown in the drawings) from the toner cartridge 78Y (see FIG. 1). A rectangular shaped opening 76A is formed at the case member 76 facing the outer peripheral face of the photoreceptor 62, and a developer roll 74 is provided at the opening 76A such that the outer peripheral face of the developer roll 74 faces the outer peripheral face of the photoreceptor 62. A plate shaped regulating member 79 for regulating the thickness of developer is provided along the length direction of the opening 76A inside the case member 76 at a position in the vicinity of the opening 76A.

The developer roll 74 is configured including a rotatably provided circular cylindrical shaped developer sleeve 74A and a magnetic member 74B formed from plural magnetic poles fixed to the inside of the developer sleeve 74A. Configuration is made such that a developer layer is formed on the outer peripheral face of the developer sleeve 74A by forming a magnetic brush of developer (carrier) by rotating the developer sleeve 74A and by regulating the thickness with the regulating member 79. The developer layer on the outer peripheral face of the developer sleeve 74A is transported to a position facing the photoreceptor 62 by rotating the developer sleeve 74A, and developing is performed by adhering toner according to the latent image (electrostatic latent image) formed on the outer peripheral face of the photoreceptor 62.

Two spiral shaped transporting rollers 77 are rotatably provided next to each other inside the case member 76. The developer filled in the case member 76 is transported in a circulating manner along the axial direction of the developer roll 74 (the length direction of the developer unit 72Y) by rotating the two transporting rollers 77. Note that the 6 developer rolls 74 provided in the developer units 72Y, 72M, 72C, 72K, 72E, 72F are each disposed around the peripheral direction such that interval between adjacent developer rolls 74 is set with a central angle of 60 degrees between the adjacent developer rolls 74. Configuration is made such that by switching over the developer unit 72, the next developer roll 74 faces the outer peripheral face of the photoreceptor 62.

As shown in FIG. 1, the intermediate transfer belt 68, serving as an example of a member to be transferred onto which a toner image formed on the outer peripheral face of the photoreceptor 62 is transferred, is provided further downstream side than the developing device 70 in the photoreceptor 62 rotation direction and below the photoreceptor 62. The intermediate transfer belt 68 is of an endless shape entrained around a drive roll 61 that is rotationally driven by a control unit 20, a tension imparting roll 65 that imparts tension to the intermediate transfer belt 68, plural transporting rolls 63 that make contact with the reverse face of the intermediate transfer belt 68 and perform driven-rotation, and an auxiliary roll 69 that makes contact with the reverse face of the intermediate transfer belt 68 at the second transfer position QB (see FIG. 2), described later, and performs driven-rotation. The intermediate transfer belt 68 is configured so as to perform circulating motion in the arrow–R direction (the anticlockwise direction in the drawing) by rotating the drive roll 61.

The first transfer roll 67 is provided at the opposite side of the intermediate transfer belt 68 to that of the photoreceptor 62, with the intermediate transfer belt 68 disposed therebetween. The first transfer roll 67 serves as an example of a first transfer member and first transfers the toner image formed on the outer peripheral face of the photoreceptor 62 onto the intermediate transfer belt 68. The first transfer roll 67 contacts with the reverse face of the intermediate transfer belt 68 at a position which is away to the downstream side in the intermediate transfer belt 68 movement direction from the position at which the photoreceptor 62 contacts with the intermediate transfer belt 68 (this is referred to as the first transfer position QA (see FIG. 2)). The first transfer roll 67 is energized from a power source (not shown in the drawings) and accordingly, due to the potential difference therefrom to the earthed photoreceptor 62, the toner image on the photoreceptor 62 is first transferred onto the intermediate transfer belt 68.

A second transfer roll 71, serving as an example of a second transfer member, is provided at the opposite side of the intermediate transfer belt 68 to that of the auxiliary roll 69, with the intermediate transfer belt 68 disposed therebetween. The second transfer roll 71 second transfers the toner image that has been first transferred onto the intermediate transfer belt 68 onto the recording paper P. The second transfer position QB (see FIG. 2) is present between the second transfer roll 71 and the auxiliary roll 69, where the toner image is transferred onto the recording paper P. The second transfer roll 71 contacts with the front face of the intermediate transfer belt 68. The second transfer roll 71 is earthed, and the toner image on the intermediate transfer belt 68 is second transferred onto the recording paper P by the potential difference between the auxiliary roll 69 that is energized from a power source (not shown in the drawings) and the second transfer roll 71.

A cleaning blade 59 is provided at the opposite side of the intermediate transfer belt 68 to that of the drive roll 61, with the intermediate transfer belt 68 disposed therebetween. The cleaning blade 59 recovers toner remaining on the intermediate transfer belt 68 after second transfer. The cleaning blade 59 is attached to a casing (not shown in the drawings) formed with an opening, and configuration is made such that toner scraped off by the leading end portion of the cleaning blade 59 is recovered inside the casing.

A position detection sensor 83 is provided at a position on the periphery of the intermediate transfer belt 68 facing one of the transporting roll 63. The position detection sensor 83 detects a predetermined reference position on the intermediate transfer belt 68 by detecting a mark (not shown in the drawings) provided on the surface of the intermediate transfer belt 68, thereby the position detection sensor 83 outputs a position detection signal that acts as a reference for start timing of image forming processing. The movement position of the intermediate transfer belt 68 is detected by the position detection sensor 83 by emitting light towards the intermediate transfer belt 68 and receiving light that has been reflected by the surface of the mark.

A cleaning device 73 is provided further downstream side than the first transfer roll 67 in the photoreceptor 62 rotation direction. The cleaning device 73 cleans toner and the like remaining on the surface of the photoreceptor 62 that has not been first transferred onto the intermediate transfer belt 68. The cleaning device 73 is configured to recover remaining toner and the like with a brush roll and a cleaning blade contacting with the surface of the photoreceptor 62.

A corotron 81 is provided upstream side of the cleaning device 73 in the photoreceptor 62 rotation direction (downstream side than the first transfer roll 67). The corotron 81 performs erasing charge of the toner that has remained on the outer peripheral face of the photoreceptor 62 after first transfer. An erasing device 75 is provided downstream side of the cleaning device 73 in the photoreceptor 62 rotation direction (upstream side than the charging member 64). The erasing device 75 illuminates light onto the outer peripheral face of the photoreceptor 62 to perform erasing charge.

The second transfer position QB of toner image by the second transfer roll 71 is provided partway along the transporting path 28. A fixing device 100 is provided at the downstream side than the second transfer roll 71 in the recording paper P transporting direction on the transporting path 28 (the arrow A direction in the drawing). The fixing device 100 fixes the toner image onto the recording paper P where the toner image has been transferred by the second transfer roll 71. Details regarding the fixing device 100 are given below.

Transporting rolls 39 are provided on the transporting path 28 further downstream side in the recording paper P transporting direction than the fixing device 100, that transports the recording paper P towards a discharge unit 15 or the reversing section 33. Toner cartridges 78Y, 78M, 78C, 78K, 78E, 78F accommodating therein each of the toners, respectively yellow (Y), magenta (M), cyan (C), black (K), first special color (E) and second special color (F), are exchangeably provided next to each other in a row along the arrow H direction below the original reading device 56 and above the developing device 70. The first special color E and the second special color F are selected from special colors (including transparent) other than yellow, magenta, cyan and black, or not selected.

Explanation now follows regarding the fixing device 100.

Figure 3:
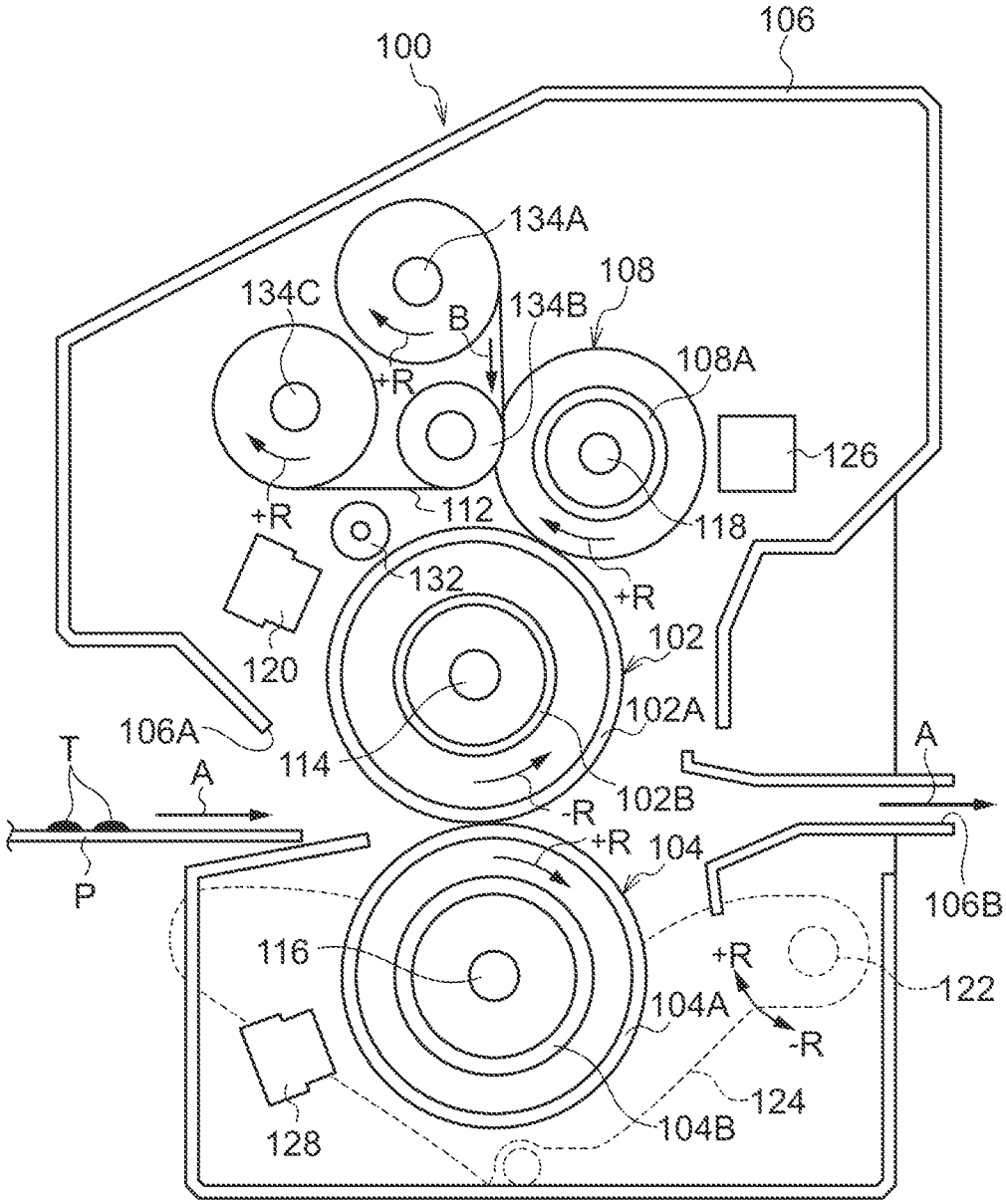
FIG. 3 is a configuration diagram of a fixing device according to an exemplary embodiment of the present invention.

As shown in FIG. 3, the fixing device 100 includes a casing 106 formed with an opening 106A into which the recording paper P is entered and an opening 106B from which the recording paper P is discharged. Provided as main components inside the casing 106 are: a fixing roll 102, serving as an example of a fixing member that performs fixing by applying heat; a press roll 104 that presses the recording paper P towards the fixing roll 102; an external heating roll 108, serving as an example of an external heating member and/or a contact member, that applies heat to the fixing roll 102; and web 112, serving as an example of an oil supply member, the web 112 making contact with the outer peripheral face of the external heating roll 108 and supplying oil (lubrication agent) to the external heating roll 108.

The fixing roll 102 is disposed on the transporting path of the recording paper P on the toner image face side (the above side). As an example, the fixing roll 102 is configured with a metal core 102B formed in a circular cylindrical shape made from aluminum, covered with a resilient member 102A formed from a silicone rubber on the outer periphery of the metal core 102B, and with a release layer (not shown in the drawings) formed from a fluororesin on the outer peripheral face of the resilient member 102A. A halogen heater 114 is provided inside the metal core 102B as a heat source in a non-contact state to the inner peripheral face of the metal core 102B. The halogen heater 114 is configured so as to generate heat by electrical continuity with a power source (not shown in the drawings), and to heat the fixing roll 102 as a whole by heating the metal core 102B.

At positions facing the outer peripheral face of the fixing roll 102A, a first temperature sensor 120 that detects the temperature of the fixing roll 102 is provided and a refresh roll 132 that levels the outer peripheral face of the fixing roll 102 is provided. The first temperature sensor 120 is a non-contact type temperature sensor, and is configured so as to detect the temperature of the fixing roll 102 by receiving thermal radiation from the fixing roll 102 with an infrared film, and detecting any rise in the temperature of this film using a thermistor. The refresh roll 132 is disposed separated from the outer peripheral face of the fixing roll 102, and configuration is made such that the refresh roll 132 is moved so as to make contact with the outer peripheral face of the fixing roll 102 when the number of sheets fixed reaches a predetermined number of sheets, thereby leveling the fixing roll outer peripheral face.

The external heating roll 108 is, for example, configured as a circular cylinder of aluminum, with circular cylindrical shaped shaft portions 108A provided at the both length direction ends thereof. A halogen heater 118 is provided inside the external heating roll 108, acting as a heat source in a non-contact state with the inner peripheral face of the external heating roll 108. The halogen heater 118 generates heat by electrical continuity with a power source (not shown in the drawings) so as to heat the external heating roll 108 as a whole.

The external heating roll 108 is provided at a position facing the outer peripheral face of the fixing roll 102, and is configured so as to be disposed in contact with the outer peripheral face of the fixing roll 102 or separated from the outer peripheral face of the fixing roll 102 by operation of a retract mechanism 140 (see FIG. 4), serving as a switching unit described below. A second temperature sensor 126 of a contact type is positioned facing the outer peripheral face of the external heating roll 108 that detects the temperature of the external heating roll 108. The halogen heater 118 heats such that, for example, the temperature of the external heating roll 108 is about 50° C. to 70° C. higher than the temperature of the fixing roll 102.

The web 112 is a fiber member for cleaning the outer peripheral face of the external heating roll 108 and is in advance impregnated with oil that acts as a lubrication agent to reduce the frictional force due to contact with the external heating roll 108. The web 112 is wound around the periphery of a shaft 134A provided so as to be capable of rotation in the arrow+R direction. An intermediate roll 134B is rotatably disposed below the shaft 134A, and a shaft 134C is disposed so as to be capable of rotation in the arrow+R direction at the left side of the intermediate roll 134B and with a separation to the intermediate roll 134B.

By the web 112 being unwound from the shaft 134A, being wound around the outer peripheral face of the intermediate roll 134B and the leading end of the web 112 being fixed to the shaft 134C, the web 112 is wound up onto the shaft 134C. Configuration is made such that, by the shaft 134C being rotationally driven by a motor (not shown in the drawings) in the arrow+R direction, the web 112 moves in the arrow B direction, makes contact with the outer peripheral face of the external heating roll 108, and is wound onto the shaft 134C. The web 112 is configured so as to be wound as required during fixing operation of the fixing device 100, and makes always contact with the external heating roll 108. Fixing operation is an operation from starting rotation of the fixing roll 102 until fixing of the toner image to the recording paper P has been completed and rotation of the fixing roll 102 is stopped, and the fixing operation includes a state in which the recording paper P is not entered into the contact portion (nip portion) between the fixing roll 102 and the press roll 104.

The press roll 104 is disposed on the transporting path of the recording paper P below the fixing roll 102. The press roll 104 is configured, for example, with a metal core 104B formed from circular cylindrical shaped aluminum and a resilient member 104A formed from a silicone rubber covering the outer periphery of the metal core 104B, and a release layer (not shown in the drawings) formed from a fluororesin formed on the outer peripheral face of the resilient member 104A. A halogen heater 116 is provided at the inside of the metal core 104B and acts as a heat source in a non-contact state with the inner peripheral face of the metal core 104B. The halogen heater 116 generates heat on electrical continuity with a power source (not shown in the drawings) and is configured to heat the press roll 104 as a whole by heating the metal core 104B.

A third temperature sensor 128 is provided at a position facing the outer peripheral face of the press roll 104, in a non-contact state to the press roll 104, that detects the temperature of the press roll 104. The third temperature sensor 128 is configured similarly to the first temperature sensor 120. The first temperature sensor 120, the second temperature sensor 126 and the third temperature sensor 128 are connected to the control unit 20 (see FIG. 1) and the control unit 20 performs output to the halogen heaters 114, 116, 118 based on the inputs from the first temperature sensor 120, the second temperature sensor 126 and the third temperature sensor 128.

Bearings (not shown in the drawings) are provided at both ends of the press roll 104, with the bearings attached to a central portion of a substantially V-shaped bracket 124. The bracket 124 is provided so as to be able to swing by operation of an eccentric cam (not shown in the drawings), in the arrow+R direction and the arrow−R direction about a shaft 122 attached to the casing 106. The press roll 104 thereby makes contact with the fixing roll 102 by the bracket 124 moving in the arrow+R direction, and the press roll 104 is separated from the fixing roll 102 by the bracket 124 moving in the arrow−R direction.

Explanation now follows regarding the retract mechanism 140 of the external heating roll 108.

Figure 4:
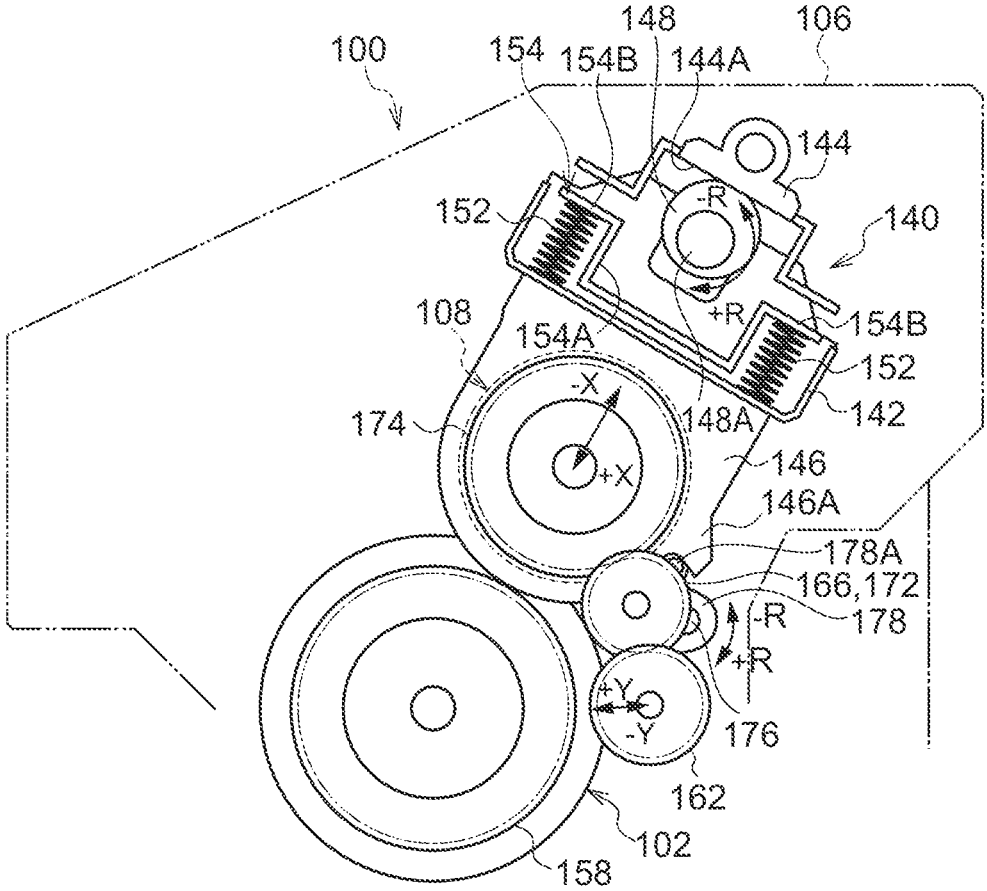
FIG. 4 is an explanatory diagram showing a mechanism for retracting an external heating roll, according to an exemplary embodiment of the present invention.

As shown in FIG. 4, the retract mechanism 140 is configured to include: brackets 142, 144 attached to the casing 106; a bracket 146 that rotatably supports the external heating roll 108; an eccentric cam 148 provided to the bracket 146; and springs 152 that bias the bracket 146. Note that in the explanation that follows, the direction in which the external heating roll 108 approaches the fixing roll 102 is denoted the +X direction, and the direction in which the external heating roll 108 separates from the fixing roll 102 is denoted the −X direction. The +X direction and the −X direction are directions sloping down to the left and up to the right, respectively, in the drawing.

The brackets 142, 144 are provided on the opposite side to that of the fixing roll 102, relative to the external heating roll 108 as the center, so as to face each other with the bracket 142 provided on the side that is near to the external heating roll 108 (the +X direction) and the bracket 144 provided on the side that is away from the external heating roll 108 (the −X direction). The bracket 142 is formed with a U-shaped cross-section, and attached to the casing 106 in a state that opens towards the bracket 144 side. A recessed portion 144A is formed at the center of the bracket 144 and the bracket 144 is attached to the casing 106 such that the recessed portion 144A faces the bracket 142.

Bearings 138 are attached to the brackets 146 (see FIG. 5), and the external heating roll 108 is rotatably supported by these bearings 138. Note that there is a pair of the brackets 146 at the both ends of the external heating roll 108, however explanation will only be give here of the one of the brackets 146 which is illustrated. The bracket 146 is restricted only in movement to the +X direction and the −X direction by a guide member (not shown in the drawings).

A flange 154 is provided at the bracket 146 so as to project out from the bracket 146 in the axial direction of the external heating roll 108. The flange 154 is configured with a U-shaped recessed portion 154A at the center thereof in cross-section when viewed along the axial direction of the external heating roll 108, and with flat portions 154B extending towards the outside from peripheral edge portions of the recessed portion 154A. The flange 154 is disposed between the bracket 142 and the bracket 144 such that the open side of the recessed portion 154A faces the recessed portion 144A of the bracket 144, and the flat portions 154B face the bracket 142. A projection portion 146A is formed at a position in the vicinity of an intermediate gear 166, described below.

The eccentric cam 148 includes a rotation shaft 148A. The eccentric cam 148 is rotatable in the arrow+R direction or the arrow−R direction due to the structure of the rotation shaft 148A being inserted into a bearing (not shown in the drawings) that is fixed at an end portion in the −X direction of the bracket 146. The eccentric cam 148 is configured so as to be rotatably driven in the +R arrow direction or the −R arrow direction by a motor (not shown in the drawings). In a case where rotated in the −R arrow direction the outer peripheral portion of the eccentric cam 148 makes contact with the recessed portion 144A of the bracket 144, and in a case where rotated in the +R arrow direction the outer peripheral portion of the eccentric cam 148 is separated from the recessed portion 144A.

One end of each spring 152 is fixed at the bracket 142 side, such that the spring 152 is sandwiched between the flat portion 154B of the flange 154 and the bracket 142. The springs 152 thereby bias the bracket 146 in the −X direction when the bracket 146 has been moved in the +X direction.

In the retract mechanism 140, configuration is made such that by that the eccentric cam 148 is rotated in the −R arrow direction and makes contact with the bracket 144, the bracket 146 moves in the +X direction, and the external heating roll 108 makes contact with the outer peripheral face of the fixing roll 102. By that the eccentric cam 148 is rotated in the +R arrow direction and separates from the bracket 144, the bracket 146 is moved in the −X direction due to biasing force from the springs 152, such that the external heating roll 108 separates from the outer peripheral face of the fixing roll 102. Namely, the retract mechanism 140 is configured to switch between contact and non-contact of the external heating roll 108 to the fixing roll 102.

Explanation now follows regarding a rotation mechanism (rotation members) of the fixing roll 102 and the external heating roll 108.

Figure 5:
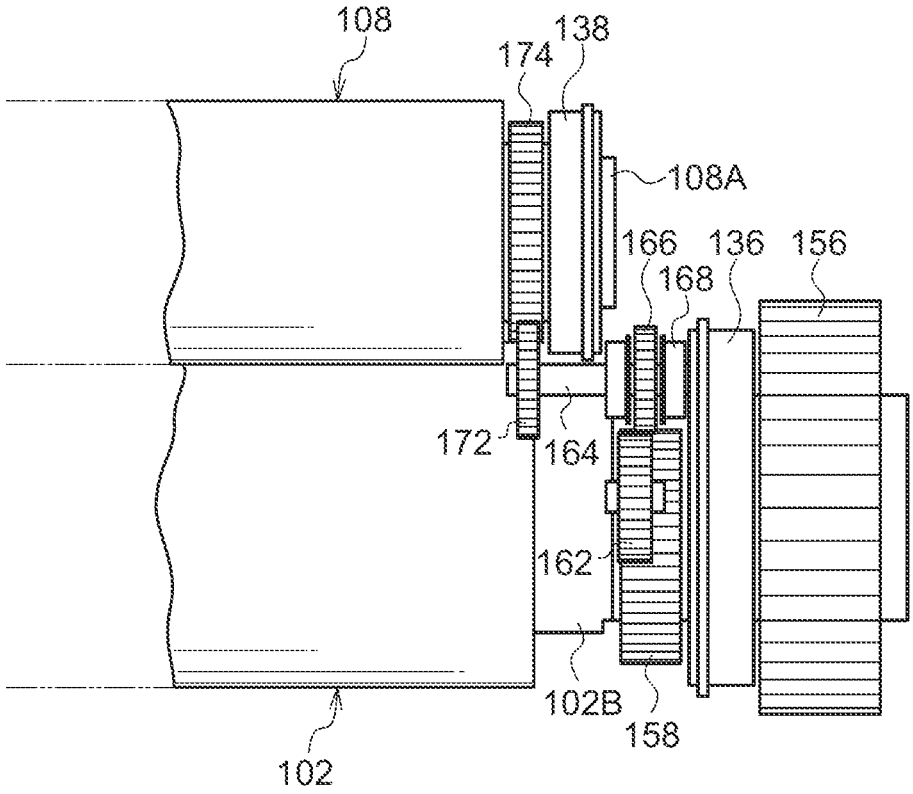
FIG. 5 is an explanatory diagram showing a meshed state of gears according to an exemplary embodiment of the present invention.

As shown in FIG. 5, a fixing side gear 156, serving as an example of a fixing member rotation member having teeth of preset number is fixed to one end portion of the metal core 102B of the fixing roll 102. A transmission gear 158 having teeth of preset number is fixed at a position which is further to the inside than the fixing side gear 156 in the axial direction of the fixing roll 102 (at the side nearer to the center), such that a bearing that rotatably supports the metal core 102B is disposed between the fixing side gear 156 and the transmission gear 158. The fixing side gear 156 is configured so as to be rotated by a motor (not shown in the drawings).

An intermediate gear 162 having teeth of preset number is rotatably provided meshed with the transmission gear 158. An intermediate gear 166 having teeth of preset number is provided so as to mesh with the intermediate gear 162 at a position which is different from that of the transmission gear 158 at the outer periphery of the intermediate gear 162. The intermediate gear 166 is fixed to one end of a shaft 164 rotatably supported by a bearing 168, and an intermediate gear 172 having teeth of preset number is fixed to the other end of the shaft 164.

An external heating side gear 174, serving as an example of a rotation member having teeth of preset number, is fixed to the shaft portion 108A at one end of the external heating roll 108 (the same side as that of the fixing side gear 156). The intermediate gear 172 is meshed with the external heating side gear 174. The transmission gear 158 and the intermediate gears 162, 166, 172 serve as an example of the rotation member (a connecting and disconnecting member).

As shown in FIG. 4, the intermediate gears 162, 166, 172 are rotatably provided with bearings (not shown in the drawings) and are supported by a bracket 178. The bracket 178 is configured so as to be able to swing by a motor (not shown in the drawings) in the arrow+R direction and the arrow−R direction about a rotation shaft 176 provided to the casing 106. The bracket 178 is biased in the +R arrow direction by a spring (not shown in the drawings). An engagement pin 178A is provided at an end portion of the bracket 178 at the side near to the bracket 146. The engagement pin 178A has a size enabling of engagement with the projection portion 146A of the bracket 146. Note that in order to facilitate clarity in the arrangement of the transmission gear 158, the intermediate gears 162, 166, 172 and the external heating side gear 174, the solid lines and broken lines shown for each in FIG. 4 are shown differently from their actual arrangement.

Figure 6A:
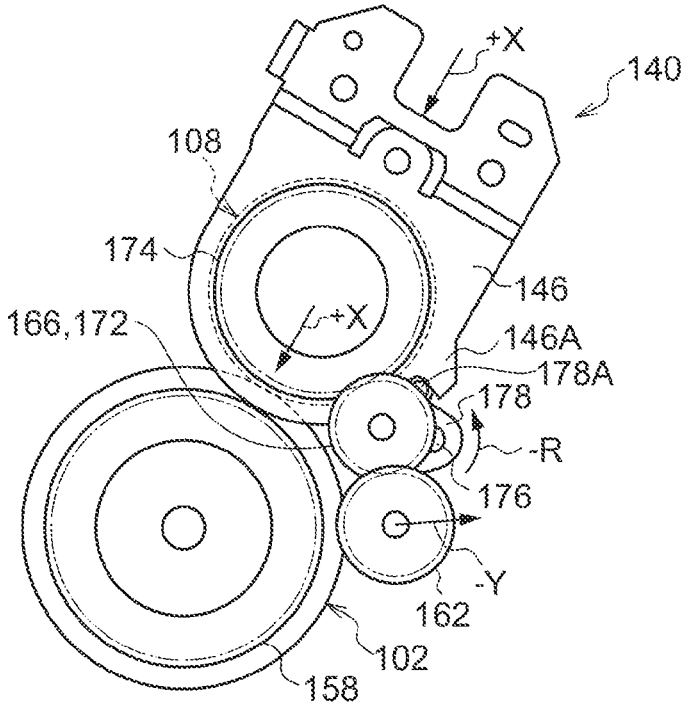
FIG. 6A and FIG. 6B are explanatory diagrams showing respective states in which an external heating roll is in a contacted state to a fixing roll, and is in a separated state from the fixing roll, according to an exemplary embodiment of the present invention.

As shown in FIG. 6A, in a case where the bracket 146 moves in the +X direction and the fixing roll 102 and the external heating roll 108 are in contact with each other (when the external heating roll 108 is in the contact position), the engagement pin 178A of the bracket 178 is pressed in the +X direction by the projection portion 146A of the bracket 146, the bracket 178 moves in the arrow−R direction, and the intermediate gear 162 is separated (disconnected) from the transmission gear 158 (moves in the −Y arrow direction in the drawing), and transmission of driving force from the fixing roll 102 to the external heating roll 108 is interrupted.

Figure 6B:
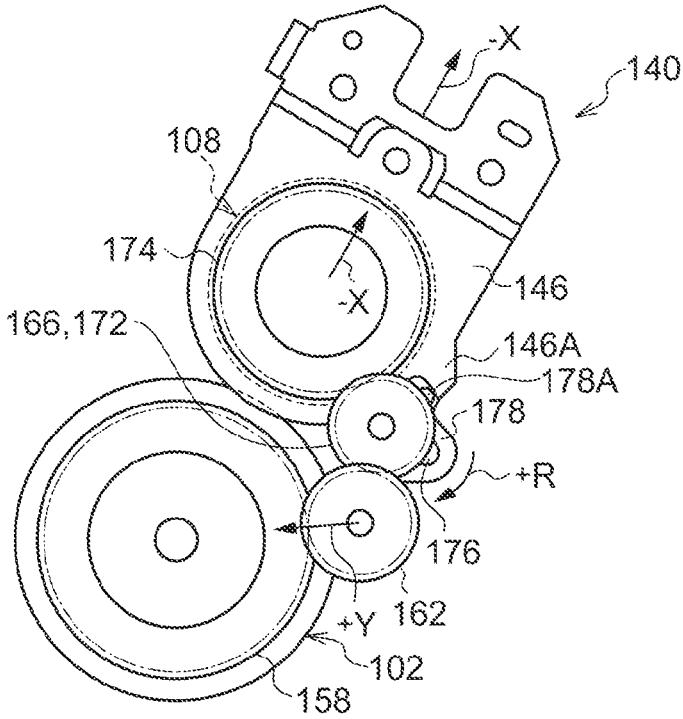

As shown in FIG. 6B, in a case where the bracket 146 moves in the −X direction and the external heating roll 108 is separated from the fixing roll 102, due to the bracket 178 being biased in the +R arrow direction by the spring (not shown in the drawings), the bracket 178 moves in the +R arrow direction, and the intermediate gear 162 meshes (connects) with the transmission gear 158 (moves in the +Y arrow direction in the drawing).

The operation of the retract mechanism 140 is pre-set in the control unit 20 (see FIG. 1), such that transmission of driving force (rotation force) from the fixing roll 102 to the external heating roll 108 is interrupted when the external heating roll 108 makes contact with the fixing roll 102, and driving force (rotation force) is transmitted from the fixing roll 102 to the external heating roll 108 when the external heating roll 108 is separated from the fixing roll 102.

Figure 9:
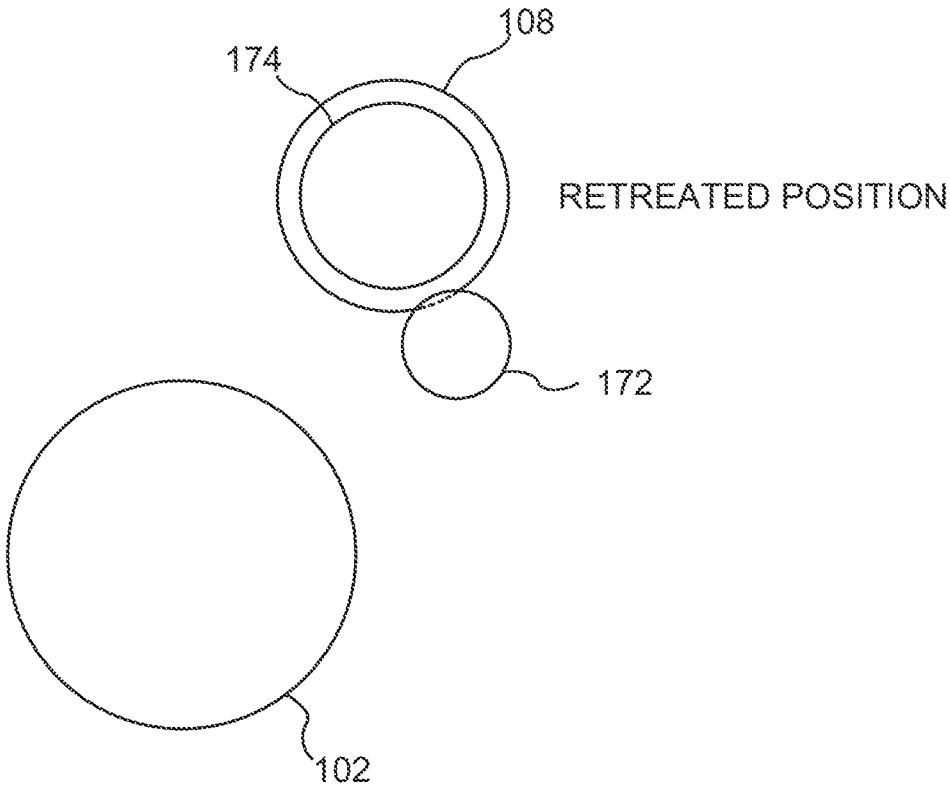
FIG. 9 is an explanatory diagram regarding another exemplary embodiment of the present invention.

In another exemplary embodiment different from the present exemplary embodiment, configuration may be made such that when the external heating roll 108 is in a retreated position (see FIG. 9), where the external heating roll 108 is separated from the fixing roll 102, the intermediate gear 172 and the external heating side gear 174 are disposed so as not to mesh with each other to place the external heating roll 108 in a stationary state, and such that the intermediate gear 172 and the external heating side gear 174 mesh with each other partway through the external heating roll 108 moving towards a contact position with the fixing roll 102, so that driving force from the fixing roll 102 is transmitted to, and rotates, the external heating roll 108. In such a configuration, since the external heating roll 108 does not rotate in the retreated position, the transfer amount of the oil from the web 112 to the external heating roll 108 is less and there is less of decrease in the amount of oil impregnated in the web 112 than in a configuration in which the external heating roll 108 rotates in the retreated position.

Explanation now follows regarding a comparative example with respect to the present exemplary embodiment.

Figure 7A:
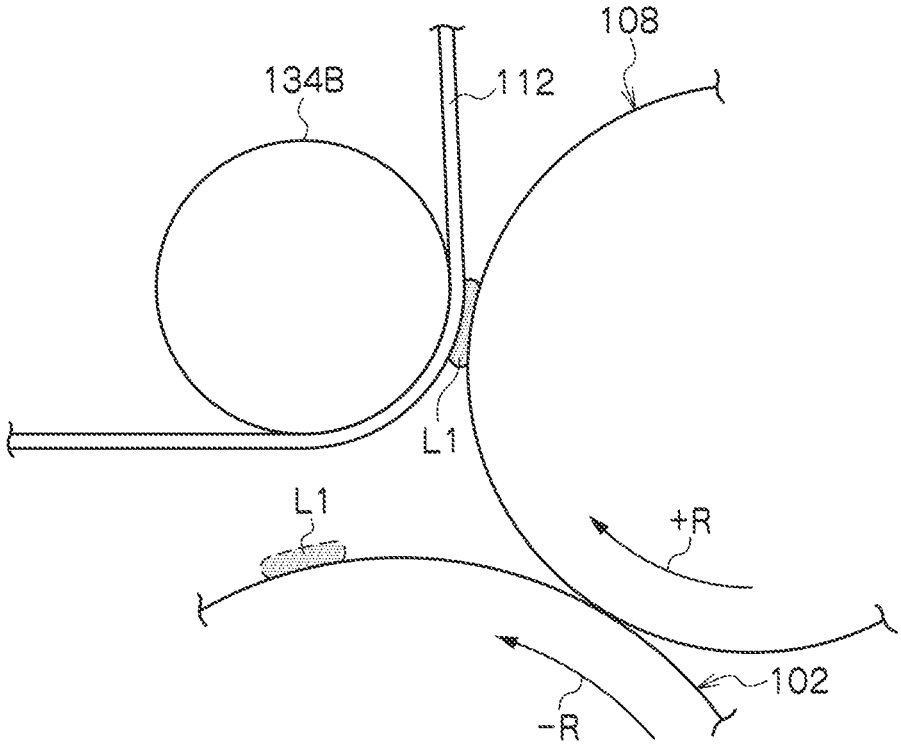
FIG. 7A and FIG. 7B are schematic diagrams showing a state in which marls of oil occur in a comparative example.

FIG. 7A shows a configuration, as the comparative example where the retract mechanism 140 of the present exemplary embodiment is not used, and the external heating roll 108 makes always contact with the fixing roll 102. In this comparative example, if the fixing operation is not performed for a long duration of time, oil that has oozed out from the web 112 accumulates between the external heating roll 108 and the web 112, resulting in the occurrence of an oil pool L1. Then, when fixing operation is started and the external heating roll 108 rotates, the oil pool L1 on the outer peripheral face of the external heating roll 108 is transferred to the outer peripheral face of the fixing roll 102 at the contact portion of the external heating roll 108 with the fixing roll 102. The oil pool L1 is then transferred to the recording paper P at the contact portion of the fixing roll 102 with the press roll 104 (see FIG. 3).

Figure 7B:
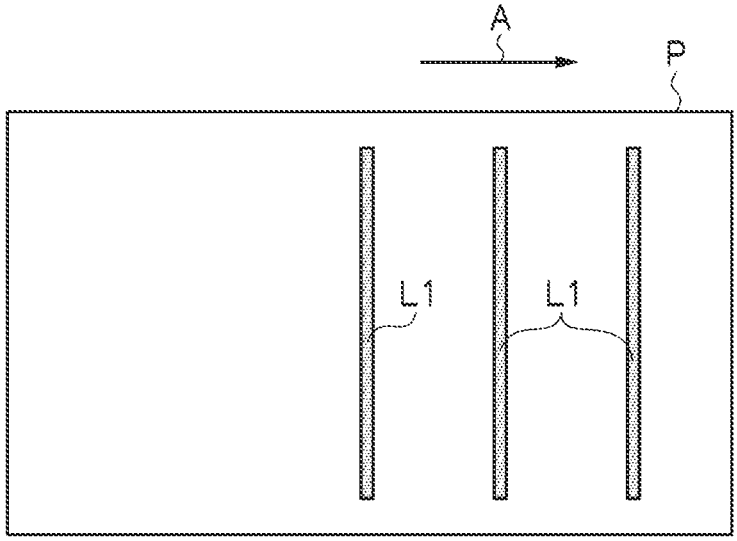

Thus, as shown in FIG. 7B, the oil pool L1 puts marks of oil on the recording paper P at intervals corresponding to the outer circumferential length of the fixing roll 102.

Explanation now follows regarding operation of the present exemplary embodiment.

Figure 8A:
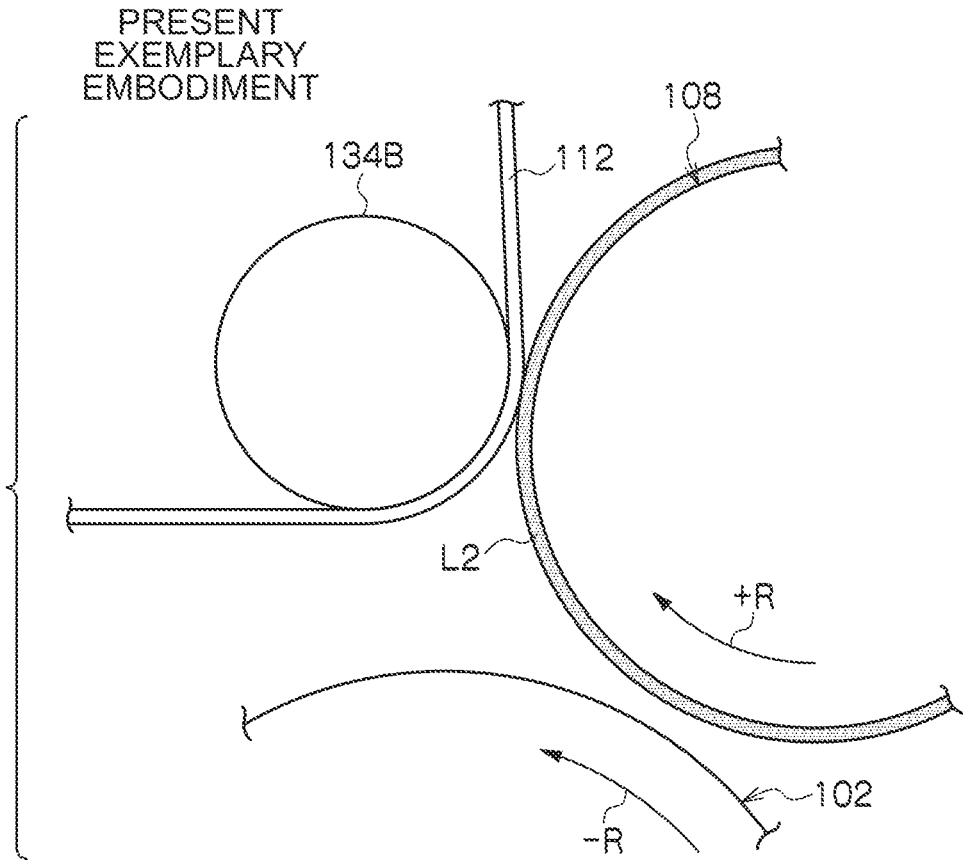
FIG. 8 is a schematic diagram showing a state in which marks of oil do not occur in an exemplary embodiment of the present invention.

As shown in FIG. 8A, in the present exemplary embodiment, prior to starting the fixing operation, the external heating roll 108 is placed in a separated state from the fixing roll 102 by the retract mechanism 140 (see FIG. 4). Then, when fixing operation is started, and the fixing roll 102 rotates, driving force is transmitted to the external heating side gear 174 (see FIG. 6B) through the transmission gear 158 and the intermediate gears 162, 166, 172 (see FIG. 6B), thereby the external heating roll 108 is rotated. Accordingly, any oil pool between the web 112 and the external heating roll 108 is spread evenly over the outer peripheral face of the external heating roll 108, forming the oil layer L2.

Then, under instruction from the control unit 20 (see FIG. 1) the eccentric cam 148 (see FIG. 4) is rotated and makes contact with the bracket 144 (see FIG. 4), the external heating roll 108 contacts with the fixing roll 102, driving force from the fixing roll 102 to the external heating roll 108 is interrupted and the external heating roll 108 is driven-rotated in accordance with the rotation of the fixing roll 102. When this occurs, the oil layer L2 on the outer peripheral face of the external heating roll 108 transfers to the outer peripheral face of the fixing roll 102 at the contact portion between the external heating roll 108 and the fixing roll 102, and is then transferred to the recording paper P at the contact portion between the fixing roll 102 and the press roll 104 (see FIG. 3).

Figure 8B:
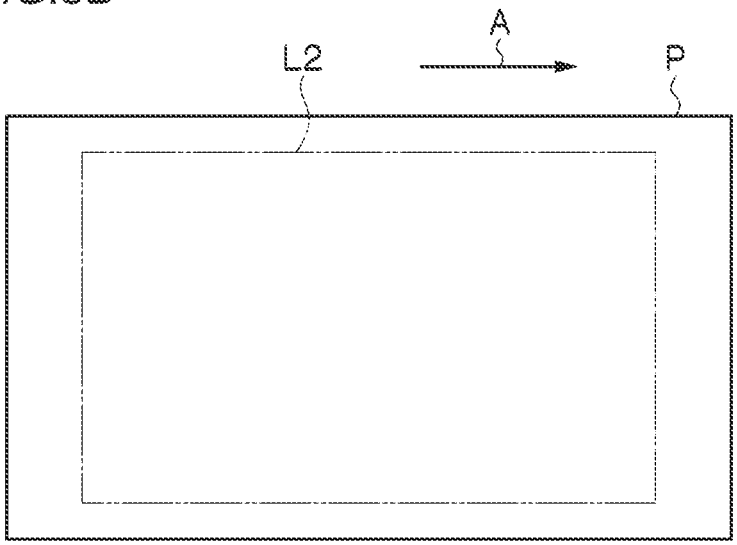

Consequently, as shown in FIG. 8B, due to the spread evenly oil layer L2 being transferred onto the recording paper P, marks of oil on the recording paper P are reduced, and marks of oil are not readily visible. Further, after starting the fixing operation, the external heating roll 108 is rotated by start of rotation of the fixing roll 102 and then the external heating roll 108 makes contact with the fixing roll 102, therefore unnecessary rotation of the fixing roll 102 is reduced in comparison to a configuration in which the external heating roll 108 is contacted with the fixing roll 102 prior to starting the fixing operation by the fixing roll 102. In addition, when the external heating roll 108 makes contact with the fixing roll 102, since the transmission of driving force to the external heating roll 108 is interrupted, load acting on the fixing roll 102 is reduced in comparison to a configuration in which driving force is transmitted to the external heating roll 108 even after the external heating roll 108 and the fixing roll 102 have made contact.

The present invention is not limited by the above exemplary embodiments.

Configuration may be made such that the fixing roll 102 is configured with a fixing belt heated by an electromagnetic induction method. An independent motor may also be provided as the driving source of the external heating roll 108. Configuration may also be made such that the external heating roll 108 is separated from the fixing roll 102 and rotated prior to rotating the fixing roll 102. Configuration may be made such that, in a state in which the external heating roll 108 is contacted to the fixing roll 102, with using the transmission gear 158 and the intermediate gears 162, 166, 172, driving force is transmitted from the fixing roll 102 to the external heating roll 108 to rotate and drive.

As another example, in a configuration in which an oil application roll, serving as an integrated contact member and oil supply member, is contacted with the fixing roll 102, configuration may be made such that the oil application roll is rotated prior to making contact with the fixing roll 102. Configuration may also be made such that an electromagnetic clutch is used to transmit driving force or interrupt transmission of driving force from the fixing roll 102 to the external heating roll 108.

What is claimed is:

1. A fixing device comprising:

a fixing member that fixes a developer image on a recording medium while rotating;

a contact member that is driven-rotated by rotation of the fixing member while contacting with an outer peripheral face of the fixing member;

an oil supply member that supplies oil to the contact member;

a switching unit that switches between contact and non-contact of the contact member to the outer peripheral face of the fixing member, the switching unit causing the contact member to contact with the outer peripheral face of the fixing member after a fixing operation by the fixing member is started; and a rotation mechanism that rotates the fixing member and rotates the contact member in a state in which the contact member is separated from the fixing member by the switching unit.

2. The fixing device of claim 1, wherein the rotation mechanism interrupts transmission of a driving force from the fixing member to the contact member when the contact member is in a retreated position where the contact member is separated from the fixing member, and transmits the driving force from the fixing member to the contact member when the contact member moves toward a contact position where the contact member contacts with the fixing member.

3. The fixing device of claim 2, wherein the rotation mechanism interrupts transmission of driving force from the fixing member to the contact member when the contact member makes contact with the outer peripheral face of the fixing member.

4. The fixing device of claim 1, wherein the rotation mechanism includes:

a fixing member rotation member that rotates the fixing member;

a contact member rotation member that rotates the contact member; and a connecting and disconnecting member that is provided to enable connection or disconnection of the fixing member rotation member and the contact member rotation member, and wherein transmission of driving force from the fixing member to the contact member is interrupted by disconnection of the fixing member rotation member and the contact member rotation member by the connecting and disconnecting member.

5. The fixing device of claim 4, wherein the fixing member rotation member is fixed to the fixing member;

the contact member rotation member is fixed to the contact member; and the connecting and disconnecting member is configured to include at least one rotation member that is provided between the fixing member rotation member and the contact member rotation member.

6. A fixing device comprising:

a fixing member that fixes a developer image on a recording medium while rotating;

an external heating member that heats the fixing member, the external heating member being driven-rotated by rotation of the fixing member while contacting with an outer peripheral face of the fixing member;

an oil supply member that supplies oil to a surface of the external heating member;

a switching unit that switches between contact and non-contact of the external heating member to the outer peripheral face of the fixing member, the switching unit causing the external heating member to contact with the outer peripheral face of the fixing member after a fixing operation by the fixing member is started; and a rotation mechanism that rotates the fixing member and rotates the external heating member in a state in which the external heating member is separated from the fixing member by the switching unit.

7. The fixing device of claim 6, wherein the rotation mechanism interrupts transmission of a driving force from the fixing member to the external heating member when the external heating member is in a retreated position where the external heating member is separated from the fixing member, and transmits the driving force from the fixing member to the external heating member when the external heating member moves toward a contact position where the external heating member contacts with the fixing member.

8. The fixing device of claim 7, wherein the rotation mechanism interrupts transmission of driving force from the fixing member to the external heating member when the external heating member makes contact with the outer peripheral face of the fixing member.

9. The fixing device of claim 6, wherein the rotation mechanism includes:

a fixing member rotation member that rotates the fixing member;

an external heating member rotation member that rotates the external heating member; and a connecting and disconnecting member that is provided to enable connection or disconnection of the fixing member rotation member and the external heating member rotation member, and wherein transmission of driving force from the fixing member to the external heating member is interrupted by disconnection of the fixing member rotation member and the external heating member rotation member by the connecting and disconnecting member.

10. The fixing device of claim 9, wherein the fixing member rotation member is fixed to the fixing member;

the external heating member rotation member is fixed to the external heating member; and the connecting and disconnecting member is configured to include at least one rotation member that is provided between the fixing member rotation member and the external heating member rotation member.

11. An image forming apparatus comprising:

a developer image forming unit that forms a developer image on a recording medium; and a fixing device that fixes the developer image formed by the developer image forming unit onto the recording medium, including:

a fixing member that fixes the developer image on the recording medium while rotating;

an external heating member that heats the fixing member, the external heating member being driven-rotated by rotation of the fixing member while contacting with an outer peripheral face of the fixing member;

an oil supply member that supplies oil to a surface of the external heating member;

a switching unit that switches between contact and non-contact of the external heating member to the outer peripheral face of the fixing member, the switching unit causing the external heating member to contact with the outer peripheral face of the fixing member after a fixing operation by the fixing member is started; and a rotation mechanism that rotates the fixing member and rotates the external heating member in a state in which the external heating member is separated from the fixing member by the switching unit.

12. An image forming apparatus comprising:

a developer image forming unit that forms a developer image on a recording medium; and a fixing device that fixes the developer image formed by the developer image forming unit onto the recording medium, including:

a fixing member that fixes the developer image on the recording medium while rotating;

a contact member that is driven-rotated by rotation of the fixing member while contacting with an outer peripheral face of the fixing member;

an oil supply member that supplies oil to the contact member;

a switching unit that switches between contact and non-contact of the contact member to the outer peripheral face of the fixing member, the switching unit causing the contact member to contact with the outer peripheral face of the fixing member after a fixing operation by the fixing member is started; and a rotation mechanism that rotates the fixing member and rotates the contact member in a state in which the contact member is separated from the fixing member by the switching unit.

* * * * *